United States Patent [19]

Lindstrom

[11] Patent Number: 5,046,930

[45] Date of Patent: Sep. 10, 1991

[54] CONNECTING ROD COOLING AND LUBRICATION

[75] Inventor: Robert A. Lindstrom, Tecumseh, Mich.

[73] Assignee: Tecumseh Products Company, Tecumseh, Mich.

[21] Appl. No.: 467,001

[22] Filed: Jan. 18, 1990

[51] Int. Cl.[5] ..... F04B 39/06; F04B 39/02

[52] U.S. Cl. ..... 417/366; 92/157; 184/6.18

[58] Field of Search ..... 184/6.18, 6.5, 6.6; 92/157; 417/366

[56] References Cited

U.S. PATENT DOCUMENTS

| | | | |
|---|---|---|---|
| 825,973 | 7/1906 | Miles | 92/157 |
| 1,584,897 | 5/1926 | Skinner et al. . | |
| 1,636,021 | 7/1927 | van Ranst . | |
| 1,878,574 | 9/1932 | Blundell | 92/157 |
| 1,892,849 | 1/1933 | Rayfield . | |
| 2,048,002 | 7/1936 | Frelin | 184/6.5 |
| 2,144,449 | 1/1939 | Church | 133/176 |
| 2,386,117 | 10/1945 | Hvid | 309/7 |
| 2,437,824 | 4/1948 | Kishline | 92/157 |
| 2,674,506 | 4/1954 | Dow | 92/157 |
| 2,926,975 | 3/1960 | Karde et al. | 184/6.5 |
| 2,959,068 | 11/1960 | Doeg | 74/579 |
| 2,964,365 | 12/1960 | Hausch | 309/20 |
| 3,059,051 | 10/1962 | Doeg | 74/579 |
| 3,131,785 | 5/1964 | Blank | 184/6 |
| 3,272,092 | 9/1966 | Vielmo et al. | 92/157 |
| 3,361,007 | 1/1968 | Belsanti et al. | 74/587 |
| 3,482,467 | 12/1969 | Volkel | 74/579 |
| 3,656,582 | 4/1972 | Alcock | 184/6.5 |
| 3,739,657 | 6/1973 | Patchen et al. | 74/587 |
| 3,992,980 | 11/1976 | Ryan | 92/157 |
| 4,269,083 | 5/1981 | Wandel | 92/157 |
| 4,363,293 | 12/1982 | Munoz et al. | 123/41.38 |
| 4,398,507 | 8/1983 | Belsanti | 123/41.38 |
| 4,515,110 | 5/1985 | Perry | 123/41.37 |
| 4,662,319 | 5/1987 | Ayoul | 123/41.35 |

FOREIGN PATENT DOCUMENTS

| | | | |
|---|---|---|---|
| 200625 | 5/1955 | Australia | 92/157 |
| 3105702 | 8/1982 | Fed. Rep. of Germany | 92/157 |

*Primary Examiner*—Leonard E. Smith
*Assistant Examiner*—David L. Cavanaugh
*Attorney, Agent, or Firm*—Jeffers, Hoffman & Niewyk

[57] ABSTRACT

A connecting rod having lubricating passages therein for cooling the piston assembly of a compressor. A central lubricating passage provides fluid communication between the crankshaft end portion and piston end portion of the connecting rod. The central lubricating passage conducts lubricant on the wrist pin, thus directly lubricating the wrist pin. The connecting rod also includes a plurality of branched passages branching from the central lubricating passage and extending through the piston end portion closely adjacent the wrist pin. Each of the branched passages is oriented to spray lubricant on the inner surface of the piston. Thus, the branched passages indirectly cool the wrist pin by drawing heat away from it and directly cool the piston by spraying lubricant thereon.

12 Claims, 2 Drawing Sheets

CONNECTING ROD COOLING AND LUBRICATION

BACKGROUND OF THE INVENTION

This invention relates generally to a connecting rod used for connecting reciprocating and rotating members in reciprocating piston machines such as internal combustion engines and compressors. More specifically, the invention is directed to a connecting rod design for use in reciprocating piston compressors to lubricate and cool the wrist pin and piston.

Connecting rods for compressors are generally designed with a piston pin ring portion and a crankshaft ring portion connected by an intermediate portion which is integral to the outer periphery of each ring portion. The piston ring portion has a bore for rotatably receiving a piston wrist pin, and the crankshaft ring portion has a bore for rotatably receiving the crankshaft. Each ring portion is reinforced at the connecting area contiguous with the intermediate portion.

Various types of connecting rods include passages therein for transmitting lubricating fluid from the crankshaft ring portion of the rod to the piston ring portion to lubricate and cool the wrist pin during operation of the compressor. Generally, it is desired to provide sufficient lubricant to the wrist pin to lubricate the load bearing areas and to transfer heat away therefrom. Efforts are continuously directed toward increasing the rate of cooling of the piston for more efficient compressor and engine performance.

SUMMARY OF THE INVENTION

The present invention improves on the above-described prior art by providing a connecting rod having branched lubricating passages immediately adjacent the wrist pin to spray lubricant on the inside surface of the piston, thereby directly cooling the piston and indirectly cooling the wrist pin by drawing heat away therefrom.

An advantage of the connecting rod of the present invention is that the wrist pin is cooled directly by the conducting of lubricant on the wrist pin from the central passage and indirectly by the cooling of the wrist pin due to cool lubricant flowing through the branched passages which are closely adjacent the wrist pin.

Another advantage of the present invention is that the branched passages spray lubricant directly on the inner surface of the piston thereby providing an efficient cooling of the piston during compression.

The present invention, in one form thereof, comprises a compressor having a hermetic housing, a crankcase including a cylinder, a piston reciprocatingly disposed within the cylinder, and a crankshaft rotatably disposed within the housing. The piston has a crown and a sidewall portion, each of which includes an inner surface. A wrist pin is operably coupled to the piston and the connecting rod. The crankshaft has an axial bore and an eccentric portion having a generally radial passage. A lubricant circulation system circulates the lubricant through the axial bore and the radial passage. The connecting rod has a crankshaft end portion disposed about the eccentric end portion of the crankshaft and a piston end portion having a wrist pin received therein. The end portions are interconnected by an intermediate portion extending therebetween. Extending axially through the intermediate portion is a central lubricating passage having an opening communicating with the radial passage. This central passage provides fluid communication between the crankshaft and the piston end portions of the connecting rod. The connecting rod further includes at least two branched lubricating passages, each of which branches from the central passage and extends through the piston end portion closely adjacent the wrist pin. The central passage is in fluid communication with the wrist pin bore to directly lubricate the wrist pin. Each of the branched passages has exit openings on the piston end portion that are oriented to spray lubricant on one of the inner surfaces of the piston. Thus, the branched passages indirectly cool the wrist pin by drawing heat therefrom upon the circulation of lubricant through the branched passages. In addition, the branched passages directly cool the piston by spraying lubricant thereon.

The invention, in one form thereof, comprises a piston assembly adapted for use in a compressor or engine having a crankshaft including an eccentric portion and a generally radial lubricating passage. A piston reciprocatingly disposed in the cylinder has a crown and a sidewall portion, each of which including an inner surface and a wrist pin operably coupled to the piston. The connecting rod has a crankshaft end portion disposed about the eccentric end portion of the crankshaft and a piston end portion having a wrist pin received therein. The end portions are interconnected by an intermediate portion extending therebetween. Extending axially through the intermediate portion is a central lubricating passage having an opening communicating with the radial passage. This central passage provides fluid communication between the crankshaft and the piston end portions of the connecting rod. The connecting rod further includes two branched lubricating passages, each of which branches from the central passage and extends through the piston end portion closely adjacent the wrist pin. The central passage is in fluid communication with the wrist pin bore to directly lubricate the wrist pin. Each of the branched passages has exit openings on the piston end portion that are oriented to spray lubricant on one of the inner surfaces of the piston. Thus, the branched passages indirectly cool the wrist pin by drawing heat therefrom upon the circulation of lubricant through the branched passages. In addition, the branched passages directly cool the piston by spraying lubricant thereon.

It is an object of the present invention to provide a connecting rod having lubricating passages which provide direct and indirect cooling of the wrist pin.

Another object of the invention is to provide a connecting rod having branched lubricating passages that provide effective cooling of the piston crown portion.

A further object of the invention is to provide a connecting rod having branched passages which provide efficient cooling of the piston and wrist pin and which can be implemented in current compressor designs without extensive modification.

BRIEF DESCRIPTION OF THE DRAWINGS

The above-mentioned and other features and objects of this invention and the manner of attaining them will become more apparent, and the invention itself will be better understood by reference to the following description of an embodiment of the invention taken in conjunction with the accompanying drawings, wherein.

The exemplifications set out herein illustrate a preferred embodiment of the invention, in one form thereof, and such exemplifications are not to be construed as limiting the scope of the disclosure or the scope of the invention in any manner.

DESCRIPTION OF THE PREFERRED EMBODIMENT

Figure 1:
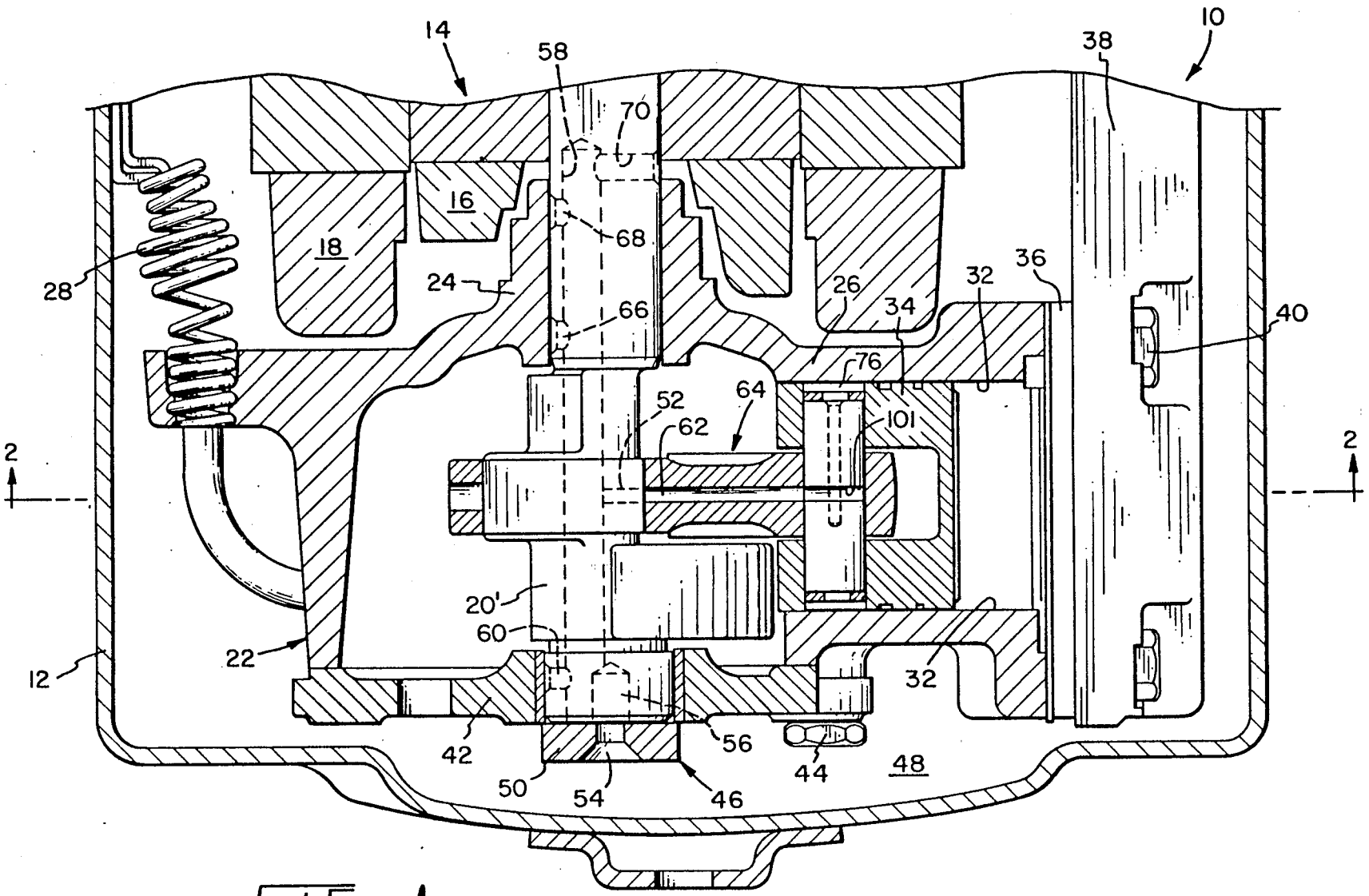
FIG. 1 is a fragmentary sectional view of a compressor, particularly showing the connecting rod of the present invention.
Figure 2:
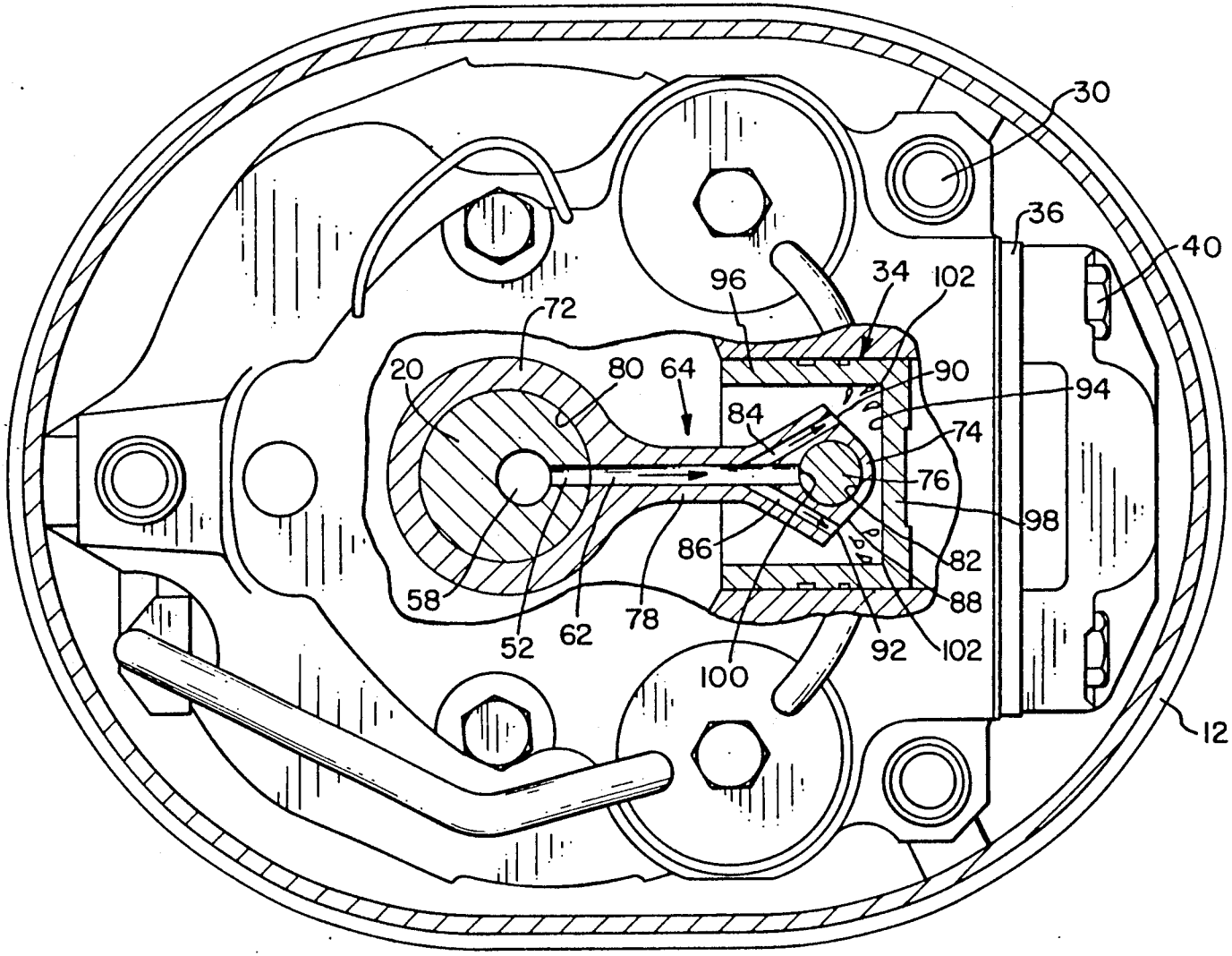
FIG. 2 is a cross-sectional view taken along line 2—2 in FIG. 1.

Referring to FIG. 1, there is shown a hermetically sealed, reciprocating piston compressor 10 including a sealed compressor housing 12 encapsulating the remainder of the compressor components. The compressor includes an electric motor 14 having a rotor 16 and stator 18. Rotor 16 is secured to crankshaft 20 which is rotatably disposed inside a crankcase 22 having a main bearing 24 and cylinder portion 26. As shown in FIG. 2, the crankcase 22 is secured to housing 12 by a plurality of internal mounting assemblies 30 including suspension springs 28.

Crankcase 22 includes a cylinder 32 in which is reciprocally received a piston 34, as is conventional. A valve plate 36 is secured between crankcase 22 and cylinder head 38 by means of bolts 40. An outboard bearing 42 is secured to crankcase 22 by means of bolts 44.

In order to provide lubrication to crankshaft 20 and piston 34, the compressor is provided with an oil pump 46, which is submerged within a reservoir of oil in sump 48. Oil pump 46 includes thrust plate 50, which is secured to outboard bearing 42.

As crankshaft 20 rotates, a pump impeller (not shown) of oil pump 46 rotates to draw lubricating oil through opening 54 in thrust plate 50. The oil travels upwardly through entrance port 56 and into passage 58 in crankshaft 20. The oil in passage 58 then divides, and a portion thereof flows through lower radial passage 60 to lubricate outboard bearing 42. Another portion flows up passage 58 and into rotating crankshaft passage 52, which provides fluid communication between axial passage 58 and a central passage 62, which is bored through connecting rod 64. Still another portion flows further upward in passage 58 and out through upper passages 66 and 68 to lubricate main bearing 24. The remainder flows through exit passage 70 to cool motor 14 and then returns to sump 48.

Referring more specifically to FIG. 2, there is shown a connecting rod 64 having an annular crankshaft end portion 72 rotatably secured to crankshaft 20, a generally annular piston end portion 74 rotatably secured to wrist pin 76, and an intermediate portion 78 integrally connecting crankshaft portion 72 to piston portion 74. One end of central passage 62 extends axially through crankshaft portion 72 and terminates at inner surface 80 thereby providing fluid communication between rotating crankshaft passage 58 and central passage 62. The other end of central passage 62 terminates at inner surface 82 of piston portion 74 to conduct lubricant directly on wrist pin 76.

Branched lubricating passages 84 and 86 each are integrally formed within piston portion 74 and extend from central passage 62 to opposite sides of wrist pin 76 and terminate at outer surface 88 of piston portion 74. Ports 90 and 92 of branched passages 84 and 86, respectively, are oriented to spray lubricant on inner surface 94 of the crown portion 98 of piston 34. Branched passages 84 and 86 are entirely contained within sidewall portion 96 of piston 34 and extend closely adjacent wrist pin 76.

In operation, lubricant flows from passage 58 to rotating crankshaft passage 52 due to the pumping action of oil pump 46. Due to the rotating motion of passage 52, passages 52 and 62 are in fluid communication only at periodic intervals, resulting in lubrication being pumped through passage 62 in pulses. The lubricant then flows through central passage 62, where a portion of lubricant passes through the smaller branched passages 84 and 86 and sprays oil on the inner surface 94 of piston 34, thus cooling piston 34. Wrist pin 76 is indirectly cooled by the flow of cool lubricant through closely adjacent branched passages 84 and 86, which conduct heat away from wrist pin 76. As the lubricant exits through ports 90 and 92, at least a portion of it is sprayed directly on the inner surface 94 of crown portion 98 of piston 34, which is the hottest portion of piston 34, thus effectively cooling the crown portion 98 by direct contact with cool lubricant. Effective cooling is also achieved by orienting ports 90 and 92 to spray lubricant directly on corner portions 102 of piston 34.

The remainder of the lubricant flows through the piston end 100 of central passage 62 into annular groove 101 of wrist pin 76 and directly conducts lubricant on wrist pin 76 to provide lubrication and cooling. The heated lubricant flows past connecting rod 64 and returns to sump 48. Thus, it can be seen, that very efficient cooling and lubrication of the wrist pin and piston is accomplished through the connecting rod of the present invention, wherein directed branched passages are provided that extend closely adjacent the wrist pin.

Although this invention has been described in connection with a reciprocating piston-type compressor, it is equally well adapted for use in any application where a connecting rod is required, most notably in engines, and it is not intended that this invention be limited in any way except as set forth in the appended claims.

What is claimed is:

1. A compressor comprising:

a housing:

a crankcase disposed within said housing, said crankcase including a cylinder;

a crankshaft rotatably disposed within said crankcase, said crankshaft including an axial bore and an eccentric portion, said eccentric portion having a passage in fluid communication with said axial bore;

a piston including a crown portion and a sidewall portion each having an inner surface;

a wrist pin operably coupled to said piston and said connecting rod;

circulation means for circulating lubricant through said axial bore and said passage; and a connecting rod having a crankshaft end portion disposed about said eccentric portion of said crankshaft, a piston end portion having said wrist pin received therein, an intermediate portion extending between an interconnecting said crankshaft and piston end portions, a central lubricating passage extending axially through said intermediate portion to provide fluid communication between said crankshaft and piston end portions and having an opening communicating with said crankshaft passage, and at least two branched lubricating passages branching from said central passage and extending through said piston end portion of said connecting rod closely adjacent said wrist pin and said branching occurring at a position between said wrist pin and the crankshaft end portion of said connecting rod, said central passage being in fluid communication with said wrist pin to directly lubricate said wrist pin, and said branched passages having exit openings on said piston end portion oriented to spray lubricant on a non-bearing inner surface of said piston, whereby circulation of lubricant through said branched passages and out said exit openings indirectly cools said wrist pin by drawing heat away therefrom, and directly cools said piston by spraying lubricant thereon.

2. The compressor assembly of claim 1, wherein said central passage has a greater diameter than each of said branched passages.

3. The compressor assembly of claim 1, wherein said exit openings of said branched passages open radially inward of said sidewall portion of said piston.

4. The compressor assembly of claim 1, wherein said branched passages are oriented to spray lubricant on said piston crown surface.

5. The compressor assembly of claim 1, wherein said branched passages are oriented to spray lubricant on a corner portion of said piston defined by said crown portion and said sidewall portion.

6. A compressor comprising:

a housing:

a crankcase disposed within said housing, said crankcase including a cylinder;

a crankshaft rotatably disposed within said crankcase, said crankshaft including an axial bore and an eccentric portion, said eccentric portion having a passage in fluid communication with said axial bore;

a piston including a crown portion and a sidewall portion each having an inner surface;

a wrist pin operably coupled to said piston and said connecting rod;

circulation means for circulating lubricant through said axial bore and said passage; and a connecting rod having a crankshaft end portion disposed about said eccentric portion of said crankshaft, a piston end portion having said wrist pin received therein, an intermediate portion extending between an interconnecting said crankshaft and piston end portions, a central lubricating passage extending axially through said intermediate portion to provide fluid communication between said crankshaft and piston end portions and having an opening communicating with said crankshaft passage, and at least one branched lubricating passages branching from said central passage and extending through said piston end portion of said connecting rod closely adjacent said wrist pin, said branching occurring at a position between said wrist pin and the crankshaft end portion of said connecting rod, said central passage being in fluid communication with said wrist pin to directly lubricate said wrist pin, and said branched passage having an exit opening on said piston end portion oriented to spray lubricant on a non-bearing inner surface of said piston, whereby circulation of lubricant through said branched passages and out said exit openings indirectly cools said wrist pin by drawing heat away therefrom, and directly cools said piston by spraying lubricant thereon.

7. The compressor of claim 11, wherein said central passage has a greater diameter than said branched passage.

8. The compressor of claim 6, wherein said branched passage is oriented to spray lubricant on said piston crown surface.

9. The compressor of claim 6, wherein said branched passage is oriented to spray lubricant on a corner portion of said piston defined by said crown portion and said sidewall portion.

10. The compressor assembly of claim 6, wherein said exit opening of said branched passage opens radially inward of said sidewall portion of said piston.

11. The compressor assembly of claim 6, wherein said branched passage is oriented to spray lubricant on said piston crown surface.

12. The compressor assembly of claim 6, wherein said branched passage is oriented to spray lubricant on a corner portion of said piston defined by said crown portion and said sidewall portion.

* * * * *

UNITED STATES PATENT AND TRADEMARK OFFICE

CERTIFICATE OF CORRECTION

PATENT NO. : 5,046,930

DATED : September 10, 1991

INVENTOR(S) : Robert A. Lindstrom

It is certified that error appears in the above-identified patent and that said Letters Patent is hereby corrected as shown below:

Claim 1, column 4, line 61, delete "an" and substitute therefor --and--.

Claim 1, column 5, line 2, delete "and" and substitute therefor --,--.

Claim 6, column 6, line 8, delete "passages" and substitute therefor -- passage--.

Claim 6, column 6, line 20, delete "openings" and substitute therefor --opening--.

Claim 7, column 6, line 1, delete "11" and substitute therefor --6--.

Signed and Sealed this

Thirtieth Day of March, 199[illegible]

*Attest:*

STEPHEN G. KUNIN

*Attesting Officer*

*Acting Commissioner of Patents and Trademarks*